US005988468A

United States Patent [19]

Murdoch et al.

[11] Patent Number: 5,988,468

[45] Date of Patent: Nov. 23, 1999

[54] EXPOSED FILM CONTAINER

[75] Inventors: Douglas H. Murdoch; Lily Ewing; Michael Sturm, all of Santa Rosa, Calif.

[73] Assignee: Daymen Photo Marketing Ltd, Markham, Canada

[21] Appl. No.: 09/007,245

[22] Filed: Jan. 14, 1998

[51] Int. Cl.[6] ..... A45F 5/00

[52] U.S. Cl. ..... 224/237; 224/235; 224/675; 224/240; 224/908; 383/41; 383/43; 383/66; 383/98; 383/119

[58] Field of Search ..... 224/191, 235, 224/236, 237, 674, 675, 908, 240, 660, 664; 383/41, 43, 66, 119, 97, 98, 99, 40; 190/114, 112; 150/118; D3/229, 230, 245; 206/391

[56] References Cited

U.S. PATENT DOCUMENTS

| | | | |
|---|---|---|---|
| 1,463,113 | 7/1923 | Bibb | 383/43 |
| 2,325,806 | 8/1943 | Simmons | 190/112 |
| 2,875,801 | 3/1959 | Borfuss | 383/99 |
| 3,122,306 | 2/1964 | Davey | 383/99 |
| 4,029,243 | 6/1977 | Zerobnick et al. | 224/664 |
| 4,180,192 | 12/1979 | Breslau | 224/235 |
| 4,246,945 | 1/1981 | Sterling | 383/43 |
| 4,406,385 | 9/1983 | Pribyl . | |
| 4,416,308 | 11/1983 | Bower | 383/57 |
| 4,884,717 | 12/1989 | Bussard et al. | 383/99 |
| 5,048,734 | 9/1991 | Long | 224/236 |
| 5,050,998 | 9/1991 | Wachtel | 383/41 |
| 5,289,960 | 3/1994 | Kelly et al. | 383/43 |
| 5,395,023 | 3/1995 | Naymark et al. | 224/245 |
| 5,411,193 | 5/1995 | Culp | 224/237 X |
| 5,439,153 | 8/1995 | Murdoch et al. | 224/664 |
| 5,465,889 | 11/1995 | Smith | 224/235 X |
| 5,558,440 | 9/1996 | Miller | 224/235 |
| 5,743,397 | 4/1998 | Traver | 206/391 |

*Primary Examiner*—Gregory M. Vidovich
*Attorney, Agent, or Firm*—The Brotman Group; R. Dabney Eastham

[57] ABSTRACT

A container for exposed film cartridges that permits swift, one-handed insertion of such cartridges while securely containing them after insertion is disclosed. A pouch with stiffened walls has a circular opening covered by overlapping flaps made of a flexible but resilient material through which cartridges may be inserted.

20 Claims, 4 Drawing Sheets

EXPOSED FILM CONTAINER

BACKGROUND OF THE INVENTION

1. Area of the Art

This invention relates to the field of package and article carriers. In particular, this invention relates to portable containers for film cartridges.

2. Description of the Prior Art

Photographers have used various devices in the past for carrying cartridges or rolls of film after the film is exposed and before it is developed. Exposed film cartridges have been carried in the photographer's pants or coat pockets, pockets sewn into or onto a camera or photographer's bag, ditty bags, waist bags, and the like.

Professional photographers frequently expose many cartridges or rolls of film in a short period of time. For example, sports photographers may expose dozens of rolls or cartridges of film while covering a single sporting event. As a result, these photographers need a readily accessible container for carrying cartridges of exposed film. The professional photographer must be able to remove the exposed film cartridge from his or her camera, put it into the container, and load an unexposed cartridge in a short period of time. Professional photographers prefer to use a special container for storing the exposed film cartridges in order to keep separate the cartridges that are exposed from those that are not exposed. In addition, the exposed film container may be handed to a runner to be taken to a developing facility for immediate development of the exposed film. The exposed film container should therefore be readily accessible to the photographer's hands by being attachable to the photographer's equipment, vest or waist belt. It should be detachable so that it can be given to a runner.

In the past, professional photographers and some amateurs have used belt pouches or pockets as containers for exposed cartridges. These typically are bags made of cloth that are attachable to a belt or strap by means of sewn-on loops of cloth. These bags have zippers that permit access to the interior of the bags, openings with drawstring closures, or closure flaps secured by hook and loop fastening strips. Such pouches provide secure enclosures for the exposed film cartridges when their zippers, drawstrings or closure flaps are properly secured. This is important because the photographer may have to run to obtain a good position for taking photographs, especially in fast-moving sporting events such as football games. The pouches that have been used previously are not, however, easy to open or close with one hand and thus take some time to open and close.

What is needed, therefore, is a container or pouch for exposed film cartridges that allows quick, one-handed insertion of exposed film cartridges yet securely contains the exposed film cartridges even when the photographer is running or climbing. In addition, an exposed film container or pouch should have means for permitting it to be carried by the photographer at a convenient position with respect to the photographer's body so that the photographer may easily reach it in order to insert exposed film cartridges.

SUMMARY OF THE INVENTION

An exposed film container according to the invention meets these needs by providing a container for quick storage of small objects such as film cartridges, comprising a longitudinally extending housing having an open end defining an opening and a closed end and one or more resilient and flexible members attached to the open end of the housing and deployed so as to cover the opening to prevent the egress of small objects contained in the housing, but permitting the swift one-handed insertion of the small objects into the housing through a dilating aperture defined by the members.

A portable container for quick storage of film cartridges and the like may also comprise a pouch having walls that define a compartment and an opening, the opening permitting access into the compartment, and a plurality of overlapping flaps attached to the walls and covering the opening in such a way that film cartridges and the like may be inserted into the compartment through the flaps and the flaps prevent the exit of the film cartridges. The opening may be provided with a ring or other stiffening means in order to maintain the shape of the opening so that the overlapping flaps are maintained in their proper position to perform the described functions. The walls of the container may be stiffened so that the opening remains above the compartment so that cartridges may be pushed inside easily.

The container may be provided with a strap or other means attached to it to permit a photographer or other person to carry the container. The walls of the container may be provided with means for removing the cartridges.

DESCRIPTION OF THE FIGURES

Further and other features of the invention will be more clear from reference to the enclosed drawings, which illustrate a preferred embodiment, and in which.

DETAILED DESCRIPTION OF A PREFERRED EMBODIMENT OF THE INVENTION

Figure 1:
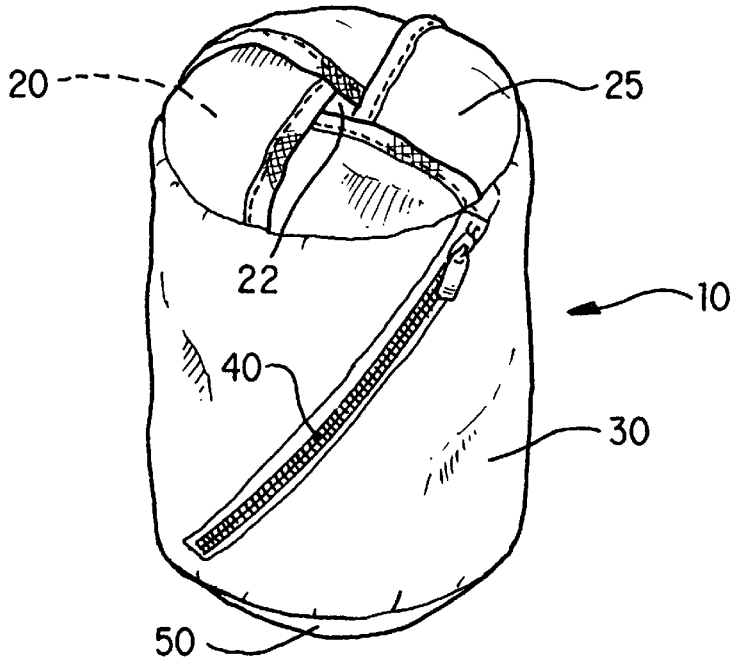
FIG. 1 is a perspective view of a preferred embodiment of an exposed film container according to the invention.

A preferred embodiment of the exposed film container 10 according to the invention is shown in FIG. 1. The exposed film container 10 is in the form of a pouch or longitudinally extending housing. The container 10 has a top or open end defining circular top opening 20. Four members or flaps 25 are spaced equidistantly around the opening 20 in order to cover overlapping sectors of the opening. A side wall 30 contains a slanted zipper 40 and is attached to the flaps 25 at the upper end of the side wall 30 that defines the opening 20 and to a bottom wall or closed end 50 attached to a lower end of the side wall 30. The opening 20 is preferably circular but other shapes, such as square, could be employed although the container 10 may be more difficult to make.

Figure 2:
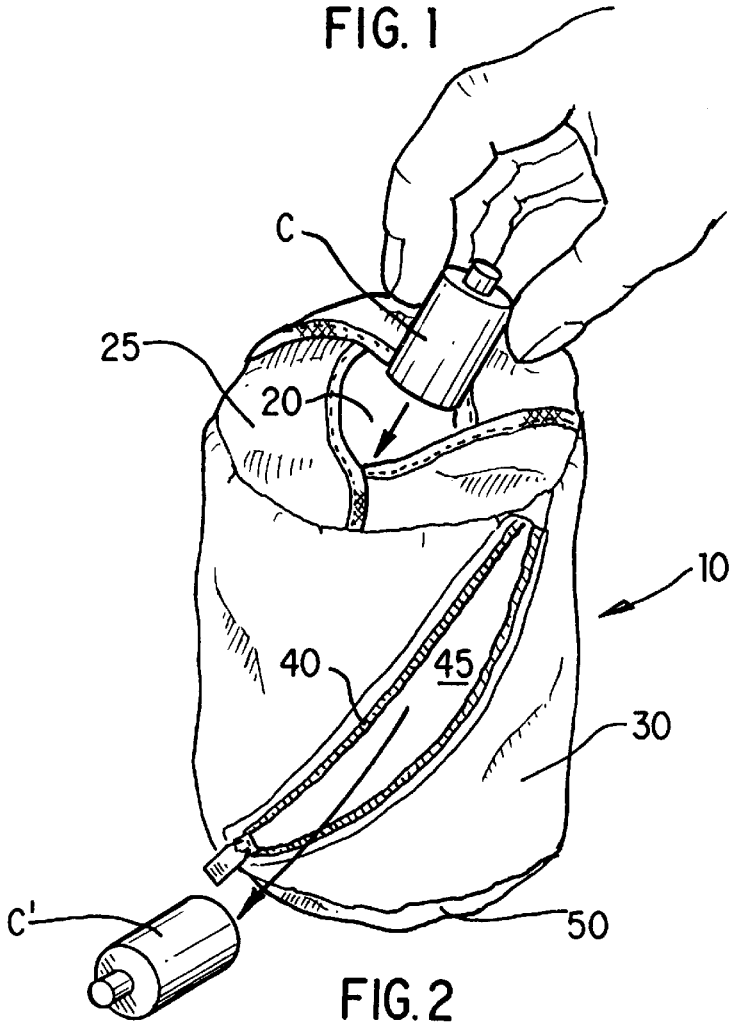
FIG. 2 is another perspective view of the exposed film container shown in FIG. 1, showing insertion and extraction of exposed film cartridges.

FIG. 2 shows how a cartridge of exposed 35 mm film C is inserted into the exposed film container 10 by being pushed through the flaps 25 and how another exposed film cartridge C' is removed through the opening 45 produced by separating the halves of the zipper 40.

Figure 3:
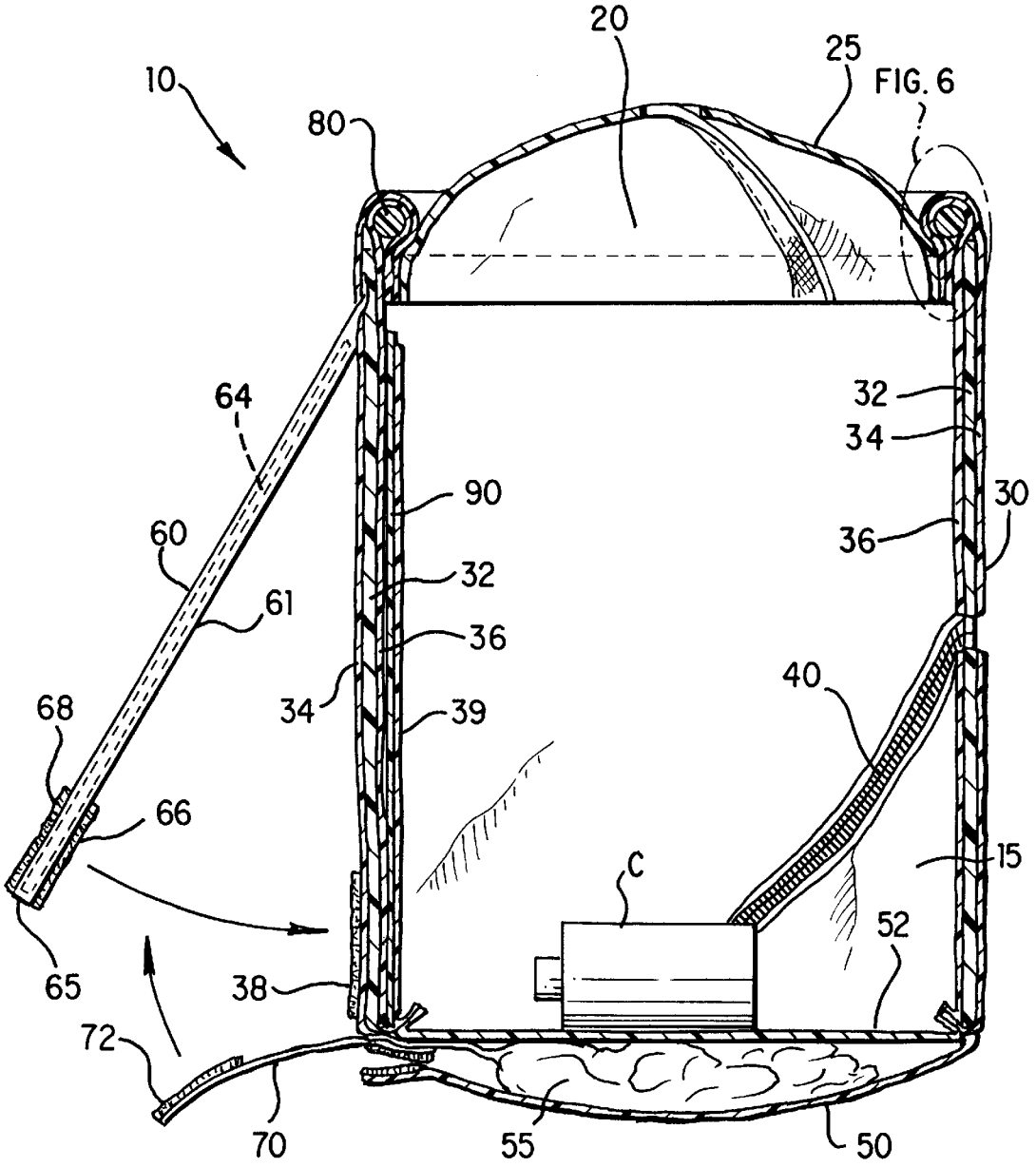
FIG. 3 is a longitudinal cross-section of the exposed film container shown in FIG. 1.
Figure 4:
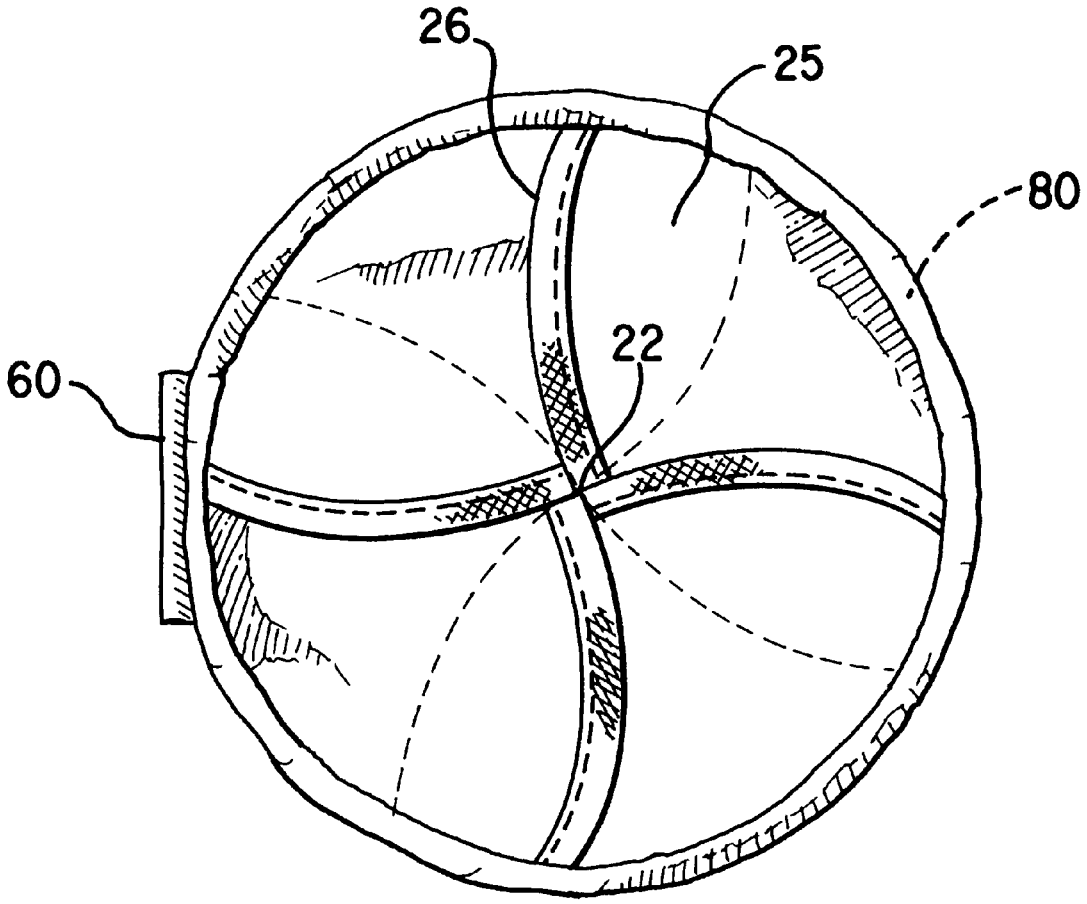
FIG. 4 is a top view of the exposed film container shown in FIG. 1.

The overlapping flaps 25 are made of a flexible and resilient material so that they will separate at a common meeting point 22 ( shown in FIGS. 1 and 4). The flaps 25 will dilate or separate to become an aperture at point 22 (as shown in FIG. 2) in order to allow film cartridges C to be pushed through the aperture into a cylindrical interior compartment 15 (see FIG. 3).

The photographer, using only one hand, thus may easily insert film cartridges through the flaps 25 and into the exposed film container 10. The flaps 25 will then return to their initial position (shown in FIG. 1) following insertion of a cartridge and will prevent the departure of film cartridges through the top of the exposed film container.

Neoprene rubber sheeting is currently preferred for the material of the flaps 25 because it is sufficiently flexible to permit the flaps 25 to be easily separated for insertion of cartridges (see FIG. 2) but also sufficiently resilient that the flaps 25 will return to their initial position (see FIG. 1). The neoprene rubber sheeting preferably has a 70D nylon fabric layer adhered to both sides of the neoprene sheeting in order to protect the sheeting from abrasion, improve its resiliency, and enhance its appearance.

It will be understood that the zipper 40 need not be slanted but could be horizontal or vertical. The film cartridges are preferably removed from the exposed film container through the zipper 40 in order to minimize permanent distortion of the overlapping flaps 25 due repeated separation or dilation of the flaps 25. Other means for securing the opening 45 may be employed, such as drawstrings or mated hook and loop fastening strips.

The cartridges C and C' shown in FIG. 2 could contain unexposed film if that is desired. It will be understood that the container 10 could be adapted for receiving and containing small objects other than film cartridges.

FIG. 3 shows how the exposed film container 10 is constructed. The side wall 30 is made of a polyethylene foam 32 sandwiched by an exterior polyester fabric 34 and an interior or lining fabric 36 made of nylon. The bottom wall 50, also preferably made of a polyester fabric, is situated below a floor 52 that may be made of the same material as the interior or lining fabric 36. The bottom wall 50 and the floor 52 are attached to the side wall 30 at a sewn seam. The interior compartment 15 therefore is defined by the interior fabric 36 of the side wall 30, the overlapping flaps 25, and the floor 52. The overlapping flaps 25 are sewn to the side wall 30 at the periphery of the circular opening 20.

Figure 6:
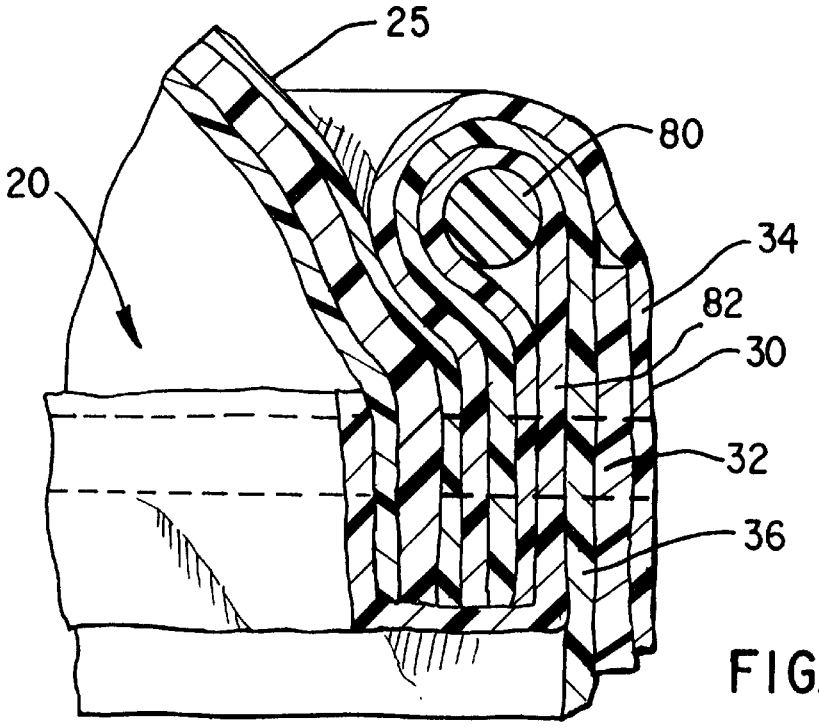
FIG. 6 is a partial enlargement of a portion of the exposed film container shown in FIG. 3.

The opening 20 is maintained in a circular shape by a ring 80 made of flexible and resilient material which is contained in a sleeve 82 sewn to the side wall 30 at the periphery of the opening 20 (best seen in FIG. 6). The ring 80 is preferably formed of a Delrin rod, with a thickness of about ⅛ to about 3/16 inches, joined at its end by a crimped metal sleeve (not shown). The opening 20 is to be maintained in a circular shape so that the overlapping flaps 25 will adequately perform their function of permitting easy insertion of cartridges while prohibiting their exit. The flaps 25 overlap each other in a dome-shaped formation over the opening 20.

A strap 60 is sewn to the side wall 30 near the top opening 20 and is hingeable at its connection 62 to the side wall 30. The strap 60 is formed by sewing a tube of polypropylene cloth 61 and inserting a rectangular plate 64 made of high density polyethylene sheet that is about ⅛ inch thick. The strap 60 is detachably secured at its lower end 65 to the side wall 30 by hook and loop fasteners 66 (sewn to the strap 60) and 38 (sewn to the side wall 30). A securing strap 70 is detachably connected to the lower end 65 of the strap 60 by hook and loop strips 72 (sewn to the securing strap 70) and 68 (sewn to the strap 60). The securing strap 70 keeps the strap 60 from detaching at its lower end 65 from the side wall 30.

The strap 60 and the securing strap 70 permit the exposed film container 10 to be detachably secured to the photographer's belt (not shown). The exposed film container 10 will not detach from the photographer's belt until the photographer consciously removes it. Removal, however, is fast and easily accomplished by the separation of the two sets of hook and loop strips 68/72 and 66/38. The photographer may thus swiftly remove the exposed film container and pass it to a runner.

It will be understood that other means for detachably connecting the container 10 to the photographer's belt, clothing, or equipment, such as hooks, snaps, and the like could be employed instead of a strap. A shoulder strap also could be attached to the container 10 so that it would be carried at approximately the height of the photographer's waist where it is accessible to the hand.

A stiffening plate 90 made of high density polyethylene sheet that is about ⅛ inch wide is inserted into a sleeve 39 sewn onto the inner fabric 36 of the side wall 30 adjacent to, and interior of, the belt strap 60.

The polyethylene foam 34 in the side wall 30 makes that wall more rigid and thus tends to prevent collapsing of the exposed film container 10. This is desirable so that the opening 20 is relatively horizontal when the exposed film container 10 is suspended from the photographer's belt. This will present the opening 20 correctly to the photographer's hand and maintain the shape of the compartment 15 for receiving the cartridges. The stiffening plate 90 adds further vertical stiffness, as does the belt strap 60.

It will be understood that other materials could be used in place of the fabrics, and foams, plates, and rings disclosed here. The walls, for example, could be molded from a thermoplastic, in which case the ring 80 would not be necessary because of the inherent rigidity of the walls, especially adjacent the opening 20. Fastening devices other than hook and loop strips, such as snaps or FASTEX® separating buckles, could be employed in connection with the strap 60.

FIG. 4 shows how the overlapping flaps 25 have arc-shaped edges. A nylon binding 26 is sewn to the interior edge of each flap 25. The binding 26 prevents wear of the otherwise vulnerable edge of the flap 25 and adds to the resiliency of the flap 25.

Figure 5:
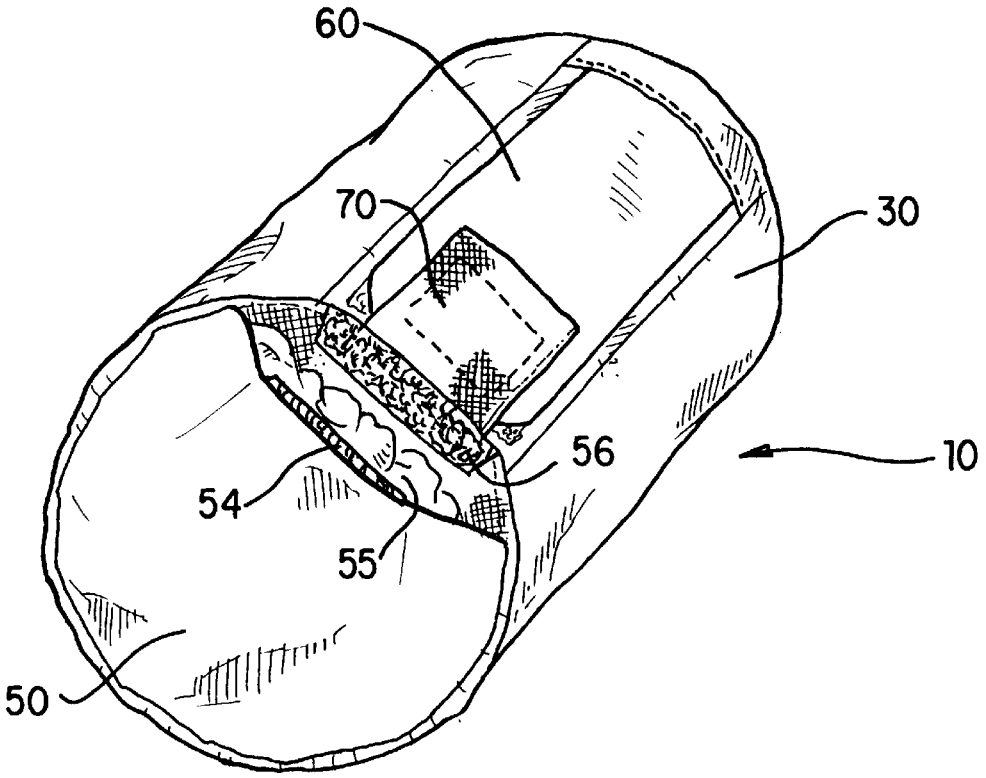
FIG. 5 is another perspective view of the exposed film container shown in FIG. 1.

FIG. 5 shows the exposed film container 10 with the belt strap 60 overlain and secured by the securing strap 70. The weather cover 55 that is normally stored in a pocket between the bottom wall 50 and the floor 52 (see FIG. 3) is exposed by the separation of the hook and loop strips 54 (sewn to the bottom wall 50) and 56 (sewn to the floor 52). A preferred construction of the weather cover 55 and its storage is disclosed in U.S. Pat. No. 5,439,153, to Murdoch et al., which is explicitly incorporated by reference as if set forth fully in this specification.

Various alterations, modifications, and improvements of the invention will readily occur to those skilled in the art in view of the particular embodiments described above. Such alternations, modifications, and improvements are intended to be part of this disclosure and are intended to be within the spirit and scope of this invention. Accordingly, the foregoing descriptions are by way of example, and are not intended to be limiting. The invention is limited only as defined in the following claims and the equivalents thereof.

We claim:

1. A portable container for quick storage of small objects, comprising:

a longitudinally extending housing defining a compartment, the housing being sized so as to be carriable at the waist of a human being and having an open end defining an opening to the compartment and a closed end; and two or more members, each having an outer and an inner surface, attached to and together covering the open end of the housing so that the inner surfaces of the members face toward the compartment and the outer surfaces of the members face away from the compartment, one of the outer and inner surfaces of each member overlapping the other of the outer and inner surfaces of an adjacent one of the other members so as to cover the opening to prevent the departure of small objects contained in the compartment through the opening, the members being made of a resilient and flexible material so that the members will displace away from each under the pressure of a small object thrust by hand against the outer surfaces of the members in order to create a dilating aperture at a common meeting point of the members that will admit the small object through the aperture directly into the compartment and the members will then return to substantially their original shape after displacement to cover the opening, thereby permitting the swift one-handed insertion of a small object into the compartment and thereafter retaining the small object in the compartment.

2. The container according to claim 1 further comprising means for removing the small objects from the compartment without dilating the aperture.

3. The container according to claim 2 in which the means for removing small objects is an opening in the housing and further comprising means for closing the opening in the housing after removing the small objects.

4. The container according to claim 1 further comprising means connected to the housing for permitting the human being to carry the container.

5. The container according to claim 4 in which the means connected to the housing is a strap for removable attachment to a belt worn by the human being.

6. The container according to claim 1 in which the housing contains a pocket containing a weather cover that is selectively deployed externally from within the pocket to cover at least the open end of the housing.

7. The portable container according to claim 1 in which the opening is circular.

8. A portable container for quick storage of film cartridges or other small objects, comprising:

a pouch that is of a size that is carriable at the waist of a human being, the pouch defining a compartment and a substantially circular opening, the opening permitting access into the compartment; and a plurality of flaps each having an outer and an inner surface attached to the pouch so that the inner surfaces of the flaps face toward the compartment and the outer surfaces of the flaps face away from the compartment, one of the outer and inner surfaces of each flap overlapping the other of the outer and inner surfaces of an adjacent one of the other members and covering the opening so as to prevent the departure through the opening of a film cartridge or small object contained in the compartment, the flaps being made of a resilient and flexible material so that the flaps will displace away from each other when a film cartridge or other small object is pushed by hand against the outer surfaces of the flaps in order to create a dilating aperture at a common meeting point of the flaps that will admit the film cartridge or other small object directly into the compartment and then will return to their original shape in order to substantially cover the opening, thereby permitting the swift one-handed insertion of the film cartridge or other small object into the compartment and thereafter retaining the film cartridge or other small object in the compartment.

9. The portable container according to claim 8 further comprising a means attached to the pouch for permitting detachable connection of the portable container to a belt.

10. The container according to claim 9 in which the means for permitting detachable connection is a strap.

11. The container according to claim 10 in which the strap has a first end that is hingeably connected to the pouch and a second end that is detachably connected to the pouch.

12. The container according to claim 8 in which a portion of the pouch adjacent the opening is stiffened to maintain the shape of the opening.

13. The container according to claim 12 in which the portion of the pouch adjacent the opening is stiffened by incorporation of a flexible and resilient ring in the pouch adjacent and encircling the opening.

14. The container according to claim 8 in which an aperture is formed in the pouch for removing any contents of the compartment, and further comprising means for reversibly closing the aperture in order to prevent the contents of the compartment from escaping through the aperture.

15. The container according to claim 14 in which the means for reversibly closing the aperture is a zipper.

16. The container according to claim 8 in which at least part of the pouch is stiffened in order to maintain the compartment in a desired shape.

17. The container according to claim 16 in which the the part of the pouch that is stiffened comprises fabric and foam sheeting.

18. The container according to claim 16 in which the shape of the compartment is generally that of a cylinder.

19. An exposed film container that is portable and quickly loaded with film cartridges while securely retaining the cartridges, comprising:

a pouch small enough to be carried at the waist of a person and having a tubular side wall with an inner side and an outer side and first and second ends, the side wall being joined at the first end of the side wall to a bottom wall, the side wall and the bottom wall defining a cylindrical chamber, and the side wall having a second end of the side wall defining a circular opening through which access may be had to the chamber from outside the pouch; and a plurality of flaps each having an outer and an inner surface attached to the second end of the side wall and extending inwardly from the second end of the side wall so that the inner surfaces of the flaps face toward the compartment and the outer surfaces of the flaps face away from the compartment, the flaps being spaced equidistantly so as to cover overlapping sectors of the circular opening in order to prevent the departure of film cartridges contained in the chamber through the opening and arranged so that one of the outer and inner surfaces of each of the flaps overlaps the other of the outer and inner surfaces of an adjacent flap of the plurality of flaps, the flaps being made of a resilient and flexible material so that the flaps will displace away from each other when a cartridge is pushed by hand against the outer surfaces of the flaps in order to create a temporary aperture at a common meeting point of the flaps that will admit the cartridge directly into the chamber and the flaps will then return to substantially their original shape in order to cover the opening, thereby permitting the swift one-handed insertion of the cartridge into the chamber and thereafter retaining the cartridge in the chamber.

20. The portable exposed film container according to claim 19 in which an aperture in the shape of a slit is defined in the tubular side wall, and further comprising a zipper attached to the tubular side wall at the location of the aperture for reversibly shutting the aperture whereby the aperture may be opened for removing the film cartridges from the chamber and shut for retaining the film cartridges in the chamber.

* * * * *